US005388797A

United States Patent [19]

Trevino et al.

[11] Patent Number: 5,388,797

[45] Date of Patent: Feb. 14, 1995

[54] SWING SET HANG TUBE PROTECTIVE MOUNTING BRACKET

[75] Inventors: Richard Trevino; Michael Wood, both of Tyler, Tex.

[73] Assignee: Roadmaster Corporation, Olney, Ill.

[21] Appl. No.: 996,909

[22] Filed: Dec. 28, 1992

[51] Int. Cl.[6] ..... A47B 96/06

[52] U.S. Cl. ..... 248/370; 472/118

[58] Field of Search ..... 248/214, 370, 130, 139; 472/118, 120, 125; 16/250, 251

[56] References Cited

U.S. PATENT DOCUMENTS

| | | | |
|---|---|---|---|
| 2,609,031 | 9/1952 | Puscas . | |
| 3,145,013 | 8/1964 | Grudoski . | |
| 3,145,024 | 8/1964 | Grudoski . | |
| 3,235,256 | 2/1966 | Grudoski . | |
| 3,409,259 | 11/1968 | Cross . | |
| 3,427,024 | 2/1969 | Cross . | |
| 3,596,906 | 8/1971 | Parmer . | |
| 3,682,504 | 8/1972 | Brimberg . | |
| 3,754,786 | 8/1973 | Boucher et al. . | |
| 3,972,563 | 8/1976 | Gustafsson . | |
| 4,018,538 | 4/1977 | Smyrni et al. . | |
| 4,190,283 | 2/1980 | Boucher . | |
| 4,408,924 | 10/1983 | Huebner . | |
| 4,822,033 | 4/1989 | Kohus et al. . | |
| 4,856,141 | 8/1989 | Sassenberg . | |
| 4,961,558 | 10/1990 | Cunard . | |
| 5,154,672 | 10/1992 | Brown | 472/118 |
| 5,176,578 | 1/1993 | Smith . | |

OTHER PUBLICATIONS

Roadmaster brochure "Roadmaster Playsafe 4-Activity Swing Set Model 6140", date unknown but bracket sold one year before filing date of this application.

Roadmaster brochure "Roadmaster Playsafe 6-Activity Swing Set Model 6160", date unknown but bracket sold one year before filing date of this application.

Outdoor Play Equipment 1993 catalog (cover and two pages).

Flexible Flyer ® Company Spring 1993 catalog (cover and three pages).

Roadmaster product brochure "Roadmaster Playsafe 4-Activity Swing Set Model 6140".

Roadmaster product brochure "Roadmaster Playsafe 6-Activity Swing Set model 6160".

*Automobile Transmission Mechanism, Lubrication, and Tires*, C. R. Strouse, p. 37.

*Primary Examiner*—Alvin C. Chin-Shue
*Assistant Examiner*—Derek J. Berger
*Attorney, Agent, or Firm*—Steven P. Shurtz

[57] ABSTRACT

A novel mounting bracket for pivotally attaching a glide ride to a playground set superstructure comprises a protective member, and a mounting flange connectable with the protective member for fixedly securing the superstructure between the protective member and the mounting flange. The mounting bracket comprises a sole connection between the glide ride and the superstructure. A pivotal connection between the glide ride and the protective member is formed on the protective member. The protective member is dimensioned for providing a protective clearance around the pivotal connection.

13 Claims, 2 Drawing Sheets

SWING SET HANG TUBE PROTECTIVE MOUNTING BRACKET

BACKGROUND OF THE INVENTION

The present invention generally relates to a novel mounting bracket for mounting play devices of a playground set to a superstructure of the set. More specifically, the invention relates to a novel swing set hang tube protective mounting bracket which mounts hang tubes to a superstructure of a swing set while also guarding a journaled connection between the hang tubes and the mounting bracket by providing protective clearances.

The general construction of a playground or swing set is well known to those having ordinary skill in the art. A swing set usually includes a plurality of play devices, such as swings, rings, ropes, glide rides, lawn swings, and the like. For the sake of clarity, the general characteristics of these devices will be discussed herein with reference to a glide ride only. However, it is to be noted that this discussion applies equally to other play devices, such as swings and the like.

One example of a play ground set of the prior art is disclosed in U.S. Pat No. 3,145,013 to Grudoski. A play ground set is shown having a glide ride. Hang bars supporting the glide ride are pivotally attached or journaled to a cross bar of a supporting superstructure by a mounting bracket. The superstructure elevates the glide ride to provide sufficient clearance between the bottom of the glide ride and the ground so that the glide ride can be freely operated. It is to be noted that the pivotal or journaled connection between the hang bars and the mounting bracket is exposed, thereby possibly allowing a child to place his fingers close to the connections. Also, there may be insufficient horizontal and/or vertical distance or clearance between the journaled connection of the hang bars and the sides or bottom edges of the mounting bracket. This insufficient clearance can also allow a child to place his fingers close to the connections, and, because the clearances are not sufficiently large, the child's fingers may be pinched or injured by the swing set. Because children, who are often the primary users of such swing sets, do not recognize the possibility of such injury, it is desirable to incorporate safety features into the constructions of the glide ride, and the swing sets in general, to reduce the probability of injury to these children. Thus, safety of the children becomes a concern of swing set manufacturers.

One point of concern for child safety is the journaled connection between the glide ride and the supporting superstructure. There may be other points of concern as well. Because of manufacturing tolerances and clearances necessary to enable the glide ride to function in an intended manner, them may be spaces or gaps between the parts of the glide ride, such as the hang bars which extend from the superstructure, and the superstructure itself. These gaps may have a size sufficient to pinch the fingers of a small child, as noted above. To reduce the chances that a child might have his fingers pinched in the gaps on a swing set, protective brackets or covers may be provided which cover the journaled connections between the glide ride and the superstructure, and therefore, the gaps. The protective covers may make it difficult for a child to put his fingers near the gaps.

One example of a swing set having a protective cover of the prior art is disclosed in the U.S. Pat. No. 4,961,558 to Cunard. This swing set includes a glide ride mounted to a supporting superstructure by a number of hang arms. The hang arms are journally mounted onto an arcuate mounting bracket, which, in turn, hangs on a cross bar of the superstructure by means of a V-shaped bolt. The protective cover itself comprises two plate-shaped members attachable to the arcuate mounting bracket by suitable fasteners. Because the arcuate mounting bracket itself does not cover the pinching gaps sufficiently to protect a child's fingers, the protective cover must cover relevant portions of the arcuate mounting bracket and the adjacent sections of the hang arms.

While this protective cover may operate satisfactorily, it does present a number of drawbacks which may make it and the associated play ground sets undesirable to some people. Namely, it is to be noted that the protective cover is separate from and attached to the mounting bracket. Thus, in order to assemble this swing set, the mounting bracket must be attached to the cross bar of the superstructure first. Specifically, according to one method of assembly, the arcuate mounting bracket is placed on top of the cross bar, and the V-shaped bolt is positioned underneath the cross bar adjacent the mounting bracket such that opposite ends of the V-shaped bolt extend through corresponding holes in the mounting bracket. Nuts are applied to the opposite ends of the V-shaped bolt, and are tightened or torqued such that the mounting bracket is fixed to the superstructure. Then, the hang arms are pivotally connected to the arcuate mounting bracket by suitable means, such as pins or bolts. The glide ride can then be attached to the ends of the hang arms opposite to the ends thereof pivotally connected to the mounting bracket. The two plate-shaped members of the protective cover are then connected to the arcuate mounting bracket by bolts or straps.

As can be appreciated, this prior art protective cover can present a person with difficulty in assembling the swing set. Because the protective cover is separate from the mounting bracket, the swing set comprises additional pans which must be put together. More fasteners must be tightened in order to attach the protective cover to the mounting bracket. Over time, one or more of these fasteners may fail, and because the protective cover is separate from the mounting bracket, the protective cover can become separated from the mounting bracket, thereby eliminating the added safety provided by the protective cover. The increased number of fasteners can also complicate the assembly process, and can increase the time needed to construct the swing set. The increased assembly time may be particularly undesirable to a parent whose children are anxiously waiting to play on the completed swing set. Thus, it is desirable to provide an improved swing set construction which is not subject to these drawbacks, among others, presented by the swing sets of the prior art. The present invention is intended to provide such an improvement.

The present invention provides a novel construction for a swing set which overcomes some, if not all of the above-discussed drawbacks. Specifically, the invention provides a novel protective mounting bracket for a swing set hang tube. The protective bracket of the invention requires fewer parts than some of the protective covers of the prior art in that the novel protective mounting bracket integrates a mounting bracket with a protective cover. Because the mounting bracket and the protective cover are integrated, the protective cover cannot become separated from the mounting bracket. Utilization of this novel protective bracket may also decrease the time needed to assemble the swing set.

SUMMARY OF THE INVENTION

A general object of an embodiment of the present invention is to provide a novel swing set hang tube protective mounting bracket.

A more specific object of an embodiment of the invention is to provide a novel swing set hang tube protective mounting bracket which makes assembly of a swing set easier and/or faster than some of the mounting brackets and/or protective covers of the prior art.

Another object of an embodiment of the present invention is to provide a novel swing set hang tube protective mounting bracket which mounts hang tubes to a superstructure and also protects or guards the journaled connection between the hang tubes and the mounting bracket.

A novel swing set hang tube protective mounting bracket, constructed according to the teachings of the present invention, for pivotally attaching a glide ride to a playground set superstructure, comprises a protective member and a mounting flange connectable with the protective member for fixedly securing the superstructure between the protective member and the mounting flange. The mounting bracket comprises a sole connection between the glide ride and the superstructure. A pivotal connection between the glide ride and the protective member is formed on the protective member. The protective member is dimensioned for providing a protective clearance around the pivotal connection.

BRIEF DESCRIPTION OF THE DRAWINGS

The organization and manner of the structure and operation of the invention, together with further advantages thereof, may best be understood by reference to the following description taken in connection with the accompanying drawings, wherein like reference numerals identify like elements in which.

DETAILED DESCRIPTION OF THE ILLUSTRATED EMBODIMENT

Figure 1:
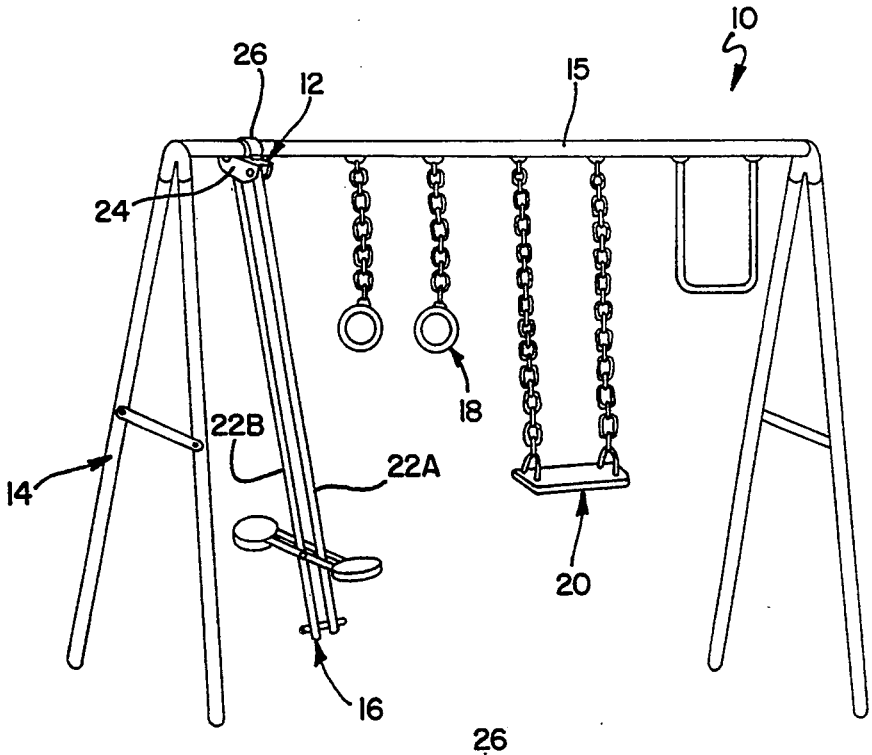
FIG. 1 is an elevational view of a swing set having a novel hang tube protective mounting bracket, constructed according to the teachings of the present invention.

While the invention may be susceptible to embodiment in different forms, there are shown in the drawings, and herein will be described in detail, specific embodiments with the understanding that the present disclosure is to be considered an exemplification of the principles of the invention, and is not intended to limit the invention to that as illustrated and described herein.

Referring initially to FIG. 1, a playground or swing set 10 having a novel protective mounting bracket 12, constructed according to the teachings of the present invention, is shown. The swing set 10 comprises a superstructure 14 including a cross bar 15 and a plurality of play devices, viz. a glide ride 16, rings 18 and a swing 20, movably attached to the superstructure 14. The constructions of these play devices 16, 18 and 20 are well known to those having ordinary skill in the art. In the illustrated embodiment, the protective mounting bracket 12 is operatively associated with the glide ride 16. While the protective mounting bracket 12 is shown in the Figures, and is discussed in detail hereinbelow with respect to its employment with the glide ride 16, it is to be noted that the protective mounting bracket 12 can be effectively utilized with other play devices without departing from the scope of the present invention.

The glide ride 16 is operatively connected to the protective mounting bracket 12 and the cross bar 15 of the superstructure 14 by a pair of hang tubes 22A and 22B. It is to be noted that the protective mounting bracket 12 forms the sole physical connection between the glide ride 16 and the superstructure 14 of the swing set 10. This is a substantial improvement over the swing set constructions of the prior art.

Figure 2:
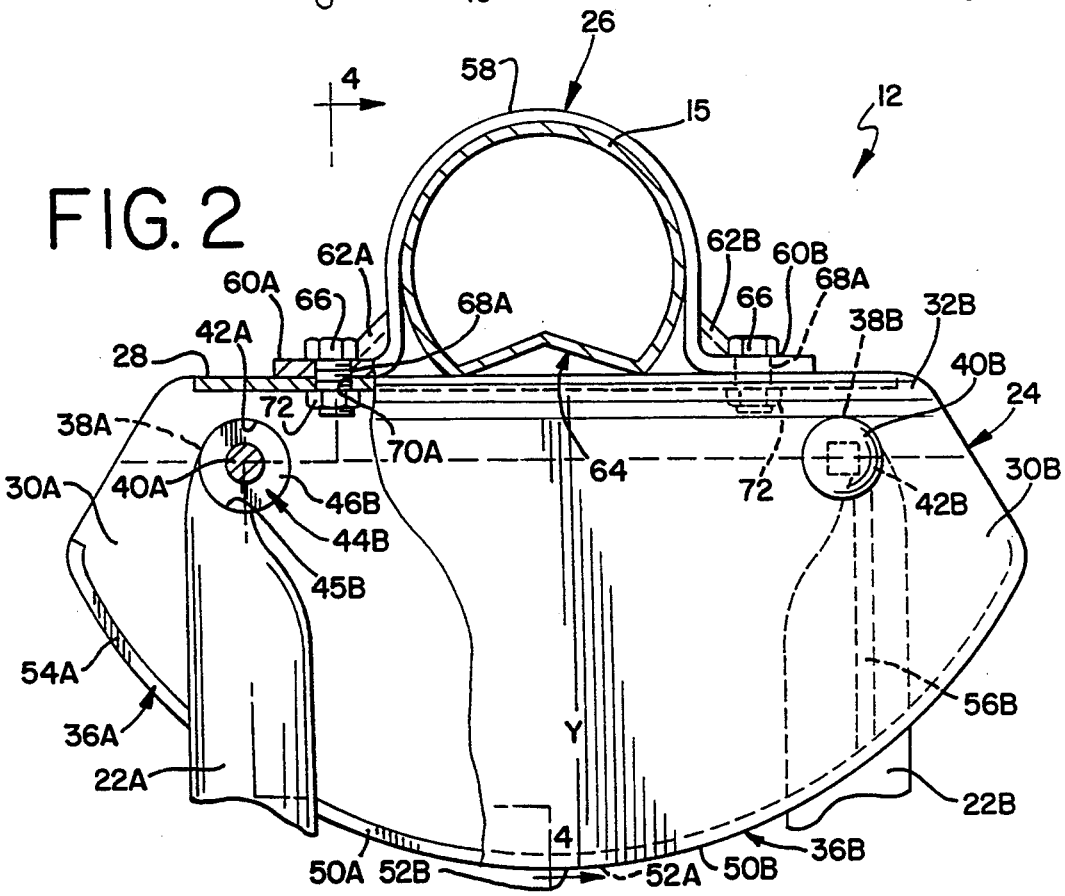
FIG. 2 is an enlarged, partially sectioned side elevational view of the novel protective mounting bracket of FIG. 1 mounting two hang tubes to a swing set superstructure.
Figure 3:
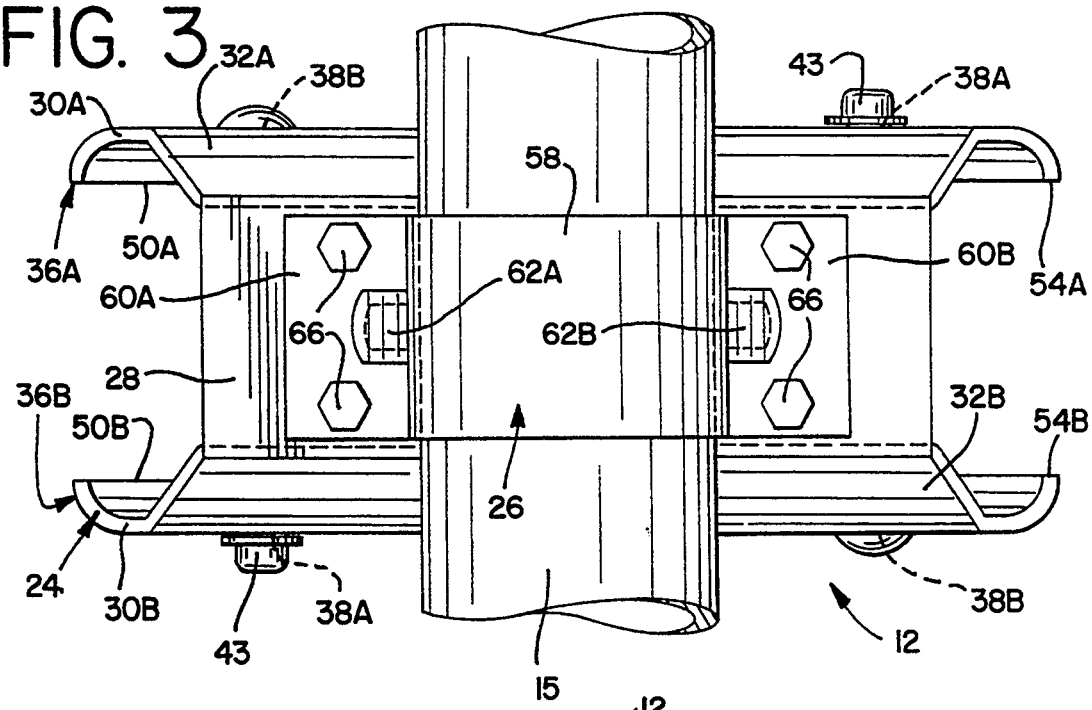
FIG. 3 is a top plan view of the protective mounting bracket of FIG. 2.
Figure 4:
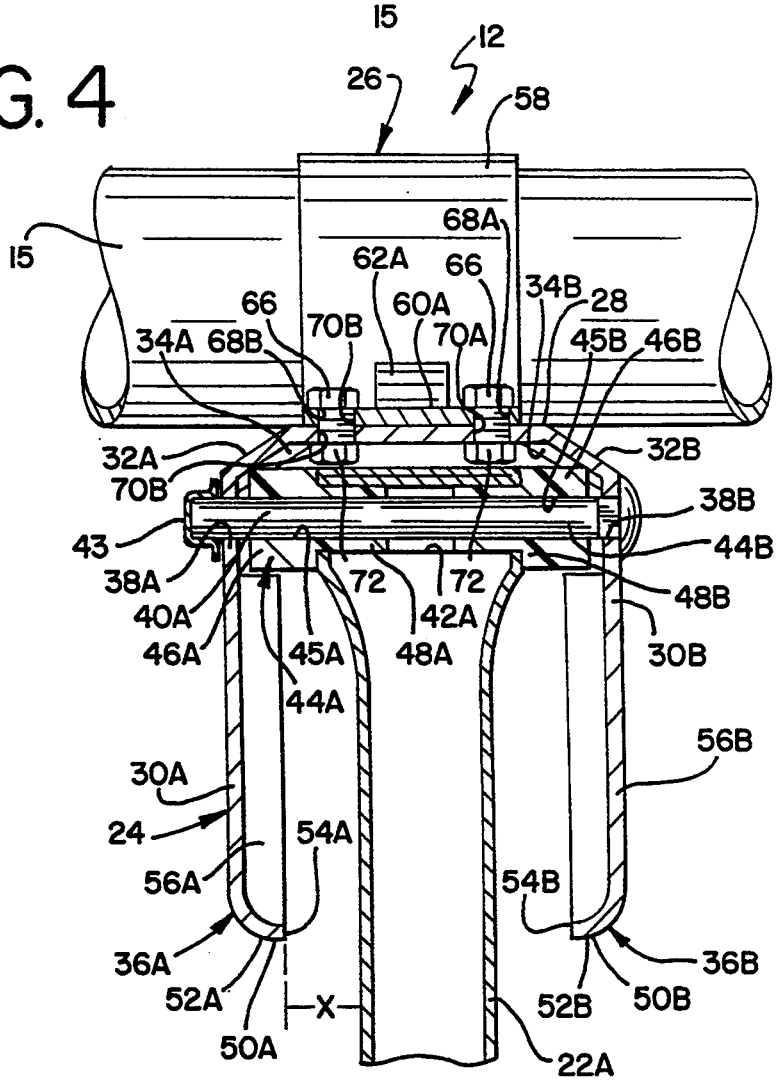
FIG. 4 is a sectional view, taken along line 4—4 of FIG. 2, of the novel hang tube protective mounting bracket.

The novel construction of the protective mounting bracket 12 is illustrated more clearly in FIG. 2 through 4. The protective mounting bracket 12 generally comprises a covering or protective member 24 and a mounting flange 26 attachable to the protective member 24. The cross bar 15 of the superstructure 14 is secured between the protective member 24 and the mounting flange 26 when the mounting flange 26 is integrally connected to the protective member 24 to form the sole physical connection between the protective mounting bracket 12 and the superstructure 14. In an exemplary embodiment, the protective member 24 and the mounting flange 26 are formed from a material, such as steel and the like, having sufficient strength to mount the glide ride 16 to the superstructure 14. The protective member 24 includes a top or substantially flat portion 28 and a pair of side or depending portions 30A and 30B which depend from opposite longitudinal sides of the flat portion 28. The top flat portion 28 has a width predetermined for locating the depending side portions 30A and 30B apart by a certain distance for accepting the hang tubes 22A and 22B therebetween. Specifically, the width of the flat portion 28 is chosen such that the horizontal or lateral distance or clearance between outer surfaces of the hang tubes 22A and 22B and inner surfaces of the depending portions 30A and 30B is sufficient to reduce the probability that a child's fingers will be pinched by the hang tubes 22A and 22B at their pivotal connection with the protective mounting bracket 12. This aspect of the invention will be discussed in greater detail later. The width and the length of the flat portion 28 also facilitate connection of the protective member 24 to the mounting flange 26.

The flat portion 28 is connected to adjacent ends of the depending portions 30A and 30B by sloped segments 32A and 32B, respectively, which slope downwardly from the flat portion 28 to the depending portions 30A and 30B along opposite longitudinal sides of the flat portion 28. In order to reinforce the sloped segments 32A and 32B, gussets 34A and 34B extend along an interior side of the sloped segments 32A and 32B, and connect the interior side of the flat portion 28 to the interior sides of the depending portions 30A and 30B. Ends of the sloped segments 32A and 32B, opposite to the ends thereof connected to the flat portion 28, define upper ends of the depending portions 30A and 30B.

The depending portions 30A and 30B extend downwardly from the ends of the sloped segments 32A and 32B a distance sufficient for providing a vertical or longitudinal clearance between distal ends 36A and 36B of the depending portions 30A and 30B and journaled connections between the protective mounting bracket 12 and the hang tubes 22A and 22B. Journal pin apertures 38A and 38B are provided through the depending portions 30A and 30B, respectively, adjacent the junctures of the depending portions 30A and 30B and the sloped segments 32A and 32B for accepting journal pins 40A and 40B. The journal pins 40A and 40B are operatively coupled to the hang tubes 22A and 22B, respectively, and form the journaled connections between the protective mounting bracket 12 and the hang tubes 22A and 22B.

The hang tubes 22A and 22B are mounted to the protective mounting bracket 12 in a front-to-back relation, as shown in FIGS. 1 and 2. Thus, there are two sets of pin apertures 38A and 38B, one set for each of the journal pins 40A and 40B, offset longitudinally on the depending portions 30A and 30B. The ends of the hang tubes 22A and 22B opposite to the ends thereof connected to the glide ride 16 include journal openings 42A and 42B, respectively, for accepting the journal pins 40A and 40B and for allowing the hang tubes 22A and 22B to rotate about the journal pins 40A and 40B. The journal openings 42A and 42B are formed by flattening the ends of the hang tubes 22A and 22B, and curving the flattened ends back towards the hang tubes 22A and 22B. In this manner, a double thickness of material is located on the hang tubes 22A and 22B adjacent top sides of the journal pins 40A and 40B in order to provide the hang tubes 22A and 22B, and thus the glide ride 16, with added strength.

The shanks of the journal pins 40A and 40B are configured for insuring proper connection between the protective mounting bracket 12 and the hang tubes 22A and 22B. Specifically, the shanks of the journal pins 40A and 40B are substantially cylindrical, however, portions of the shanks immediately adjacent the heads of the journal pins 40A and 40B have a substantially rectangular configuration. Accordingly, the pin apertures 38B adjacent the head of the journal pins 40A and 40B define a corresponding rectangular configuration, while the pin apertures 38A define a substantially circular configuration, as shown in FIG. 2. Thus, when each of the journal pins 40A and 40B are inserted through the pin apertures 38A and 38B and the journal openings 42A and 42B, the cooperation of the configurations of the pin apertures 38A and 38B and the configurations of the shanks of the journal pins 40A and 40B prevent rotation of the journal pins 40A and 40B conjointly with the hang tubes 22A and 22B. Thus, the hang tubes 22A and 22B rotate substantially freely about the journal pins 40A and 40B. In order to prevent axial movement of the journal pins 40A and 40B through the pin apertures 38A and 38B, fasteners 43 are attached to the entering ends of the journal pins 40A and 40B. In the illustrated embodiment, these fasteners 43 are in the form of pell nuts, however, other fasteners are also usable.

In order to facilitate rotation of the hang tubes 22A and 22B about the journal pins 40A and 40B, a pair of bushings 44A and 44B, visible in FIG. 4, are provided with each journal pin 40A and 40B. The bushings 44A and 44B are substantially cylindrical in shape and are preferably formed from a suitable polymeric material, such as nylon and the like. Bores 45A and 45B extend axially through the bushings 44A and 44B, respectively, so that the journal pins 40A and 40B can be inserted therethrough. The bushings 44A and 44B comprise first portions 46A and 46B and second portions 48A and 48B connected to the first portions 46A and 46B. The first portions 46A and 46B define outer diameters larger than the outer diameters defined by the second portions 48A and 48B, which define outer diameters substantially equal to the inner diameters defined by the journal openings 42A and 42B in the ends of the hang tubes 22A and 22B. Thus, the second portions 48A and 48B of the bushings 44A and 44B are insertable into the journal openings 42A and 42B in the hang tubes 22A and 22B. The bushings 44A and 44B are forced into the journal openings 42A and 42B to form a press fit therebetween, thereby allowing the bushings 44A and 44B to rotate conjointly with the hang tubes 22A and 22B about the journal pins 40A and 40B. Because the polymer comprising the bushings 44A and 44B is "softer" than the metal comprising the hang tubes 22A and 22B and the journal pins 40A and 40B, friction between the hang tubes 22A and 22B and the journal pins 40A and 40B is correspondingly reduced. In addition, the bushings 44A and 44B have a predetermined axial length such that, when the bushings 44A and 44B are inserted into the journal openings 42A and 42B in the hang tubes 22A and 22B, and the journal pins 40A and 40B are inserted through the bores 45A and 45B in the bushings 44A and 44B, opposite sides of the hang tubes 22A and 22B are substantially equidistantly spaced from the interior surfaces of the depending portions 30A and 30B. This insures that the predetermined horizontal protective clearance is maintained on opposite sides of the hang tubes 22A and 22B.

The depending portions 30A and 30B extend downwardly a certain, predetermined distance from the pin apertures 38A and 38B to provide a vertical protective clearance between the journaled coupling of the hang tubes 22A and 22B with the journal pins 40A and 40B and the distal ends 36A and 36B of the depending portions 30A and 30B. The depending portions 30A and 30B define arcuate, downwardly facing convex surfaces 50A and 50B, respectively, as illustrated in FIG. 2, to allow for rotation of the hang tubes 22A and 22B about the journal pins 40A and 40B. Thus, the protective clearance between the journaled coupling of the hang tubes 22A and 22B, the journal pins 40A and 40B, and the distal ends 36A and 36B of the depending portions 30A and 30B is measured from a horizontal plane formed by the axes of elongation of the journal pins 40A and 40B to the lowest points or apexes 52A and 52B of the depending portions 30A and 30B. In an exemplary embodiment, the distance between the axes of elongation of the journal pins 40A and 40B and the apexes 52A and 52B of the convex surfaces 50A and 50B, i.e. the vertical protective clearance, measures about 3.125 inches. This vertical protective clearance is indicated by reference character "Y" in FIG. 2. "As can be seen from FIG. 2, the radius of curvature of the arcuate surfaces 50A and 50B is greater than about 3 inches". Given these illustrations, it is to be recognized that the term protective clearance means a distance or clearance between at least two elements of a hanging structure for a glide ride 16 or the like that is sufficient to possibly reduce the probability that a child's fingers will be pinched therein.

The distal ends 36A and 36B of the depending portions 30A and 30B curve inwardly towards each other a predetermined distance to define a horizontal protective clearance between the outer surfaces of the hang tubes 22A and 22B and inner ends 54A and 54B of the depending portions 30A and 30B. In an exemplary embodiment, this protective clearance measures about 0.563 inches, and is indicated by reference character "X" in FIG. 4. Thus, the protective clearance between the outer surfaces of the hang tubes 22A and 22B and the inner ends 54A and 54B of the depending portions 30A and 30B does not form a "pinch point," which is defined by standard to be a clearance equal to or less than 0.5 inches. Thus, the horizontal protective clearance should be at least greater than 0.5 inches. In order to provide structural support to the depending portions 30A and 30B, gussets 56A and 56B extend along interior surfaces of the depending portions 30A and 30B. In the illustrated embodiment, the gussets 56A and 56B extend along the inner surfaces of the depending portions 30A and 30B from positions offset downwardly from the pin apertures 38A and 38B to the inner ends 54A and 54B of the depending portions 30A and 30B, as shown in FIG. 4.

The construction of the mounting flange 26 is illustrated in FIGS. 2 and 3. The mounting flange 26 comprises a substantially arcuate portion 58 and two planar or flat portions 60A and 60B disposed on opposite lateral ends of the arcuate portion 58. To reinforce the connections between the arcuate portion 58 and the flat portions 60A and 60B, gussets 62A and 62B, respectively, extend from an outer surface of the arcuate portion 58 to outer surfaces of the flat portions 60A and 60B. The arcuate portion 58 defines a radius substantially equal to the radius of the cross bar 15. In this manner, the arcuate portion 58 can accept a portion of the cross bar 15, for attaching the protective mounting bracket 12 to the superstructure 14. The flat portions 60A and 60B define a plane such that, when the arcuate portion 58 is placed over the cross bar 15, the flat portions 60A and 60B can contact the flat portion 28 of the protective member 24. In order to facilitate this contact, a portion of the cross bar 15 which is inserted into the arcuate portion 58 includes an indentation 64, shown in FIG. 2. The indentation 64 reduces the effective dimensions of a portion of the cross bar 15 so that the flat portions 60A and 60B can firmly engage the flat portion 28.

To insure a tight fit between the protective member 24 and the mounting flange 26, and therefore a tight connection between the protective mounting bracket 12 and the superstructure 14, a plurality of fasteners, in the form of bolts 66 in the illustrated embodiment, are provided. In the illustrated embodiment, four bolts 66 are used, two bolts 66 extending through each of the flat portions 60A and 60B into the flat portion 28. To accept the bolts 66, each flat portion 60A and 60B includes a pair of apertures 68A and 68B laterally offset from each other on the flat portions 60A and 60B. The flat portion 28 also includes a pair of apertures 70A and 70B for allowing the shanks of the bolts 66 to extend from the top sides of the flat portions 60A and 60B to the inner side of the flat portion 28. To secure the protective member 24 to the mounting flange 26, nuts 72 are attached to the ends of the bolts 66 adjacent the inner surface of the flat portion 28. Thus, when the nuts 72 are properly tightened, the weight of the glide ride 16, and any children thereon, is transferred through the hang tubes 22A and 22B to the journal pins 40A and 40B, from the journal pins 40A and 40B to the protective mounting bracket 12, from the protective mounting bracket 12 to the superstructure 14, and from the superstructure 14 to the ground.

With the novel structure of the swing set 10, and specifically of the protective mounting bracket 12 being thusly disclosed in detail, the following discussion of the novel assembly of the swing set 10 and the protective mounting bracket 12 will now be discussed in detail. The following discussion is provided as an example only, and is not intended to limit the scope of the invention. A greater appreciation of the structure of the embodiments of the invention may be gained by reference to the following discussion. For the sake of clarity, the assembly of the swing set 10 will be limited to a discussion of the mounting of the glide ride 16. Assembly of the other play devices 18 and 20 is well known in the art.

To mount the glide ride 16 onto the superstructure 14, the mounting flange 26 is placed over the cross bar 15 of the superstructure 14 such that the arcuate portion 58 aligns with the indentation 64. The flat portion 28 of the protective member 24 is placed against the flat portions 60A and 60B of the mounting flange 26 such that the apertures 68A and 68B on the flat portions 60A and 60B align with the apertures 70A and 70B on the flat portion 28. The bolts 66 are inserted from the top side of the flat portions 60A and 60B through the apertures 68A and 68B, and 70A and 70B. Nuts 72 are threadibly applied to the ends of the bolts 66 which depend beyond an inner surface of the flat portion 28 of the protective member 24. The nuts 72 are then tightened to fixedly attach the protective mounting bracket 12 to the superstructure 14. The out-of-round configuration of the cross bar 15 formed by the indentation 64 assists in preventing rotation of the protective mounting bracket 12 about the cross bar 15.

With the protective mounting bracket 12 being attached to the superstructure 14, the hang tubes 22A and 22B can now be pivotally connected to the protective mounting bracket 12. The second portions 48A and 48B of the bushings 44A and 44B are inserted through opposite ends of the journal openings 42A and 42B in the hang tubes 22A and 22B. The second portions 48A and 48B are force-fitted into the journal openings 42A and 42B to insure firm coupling of the hang tubes 22A and 22B with the bushings 44A and 44B. Fully seating the second portions 48A and 48B into the journal openings 42A and 42B insures proper horizontal protective clearance between the outer surfaces of the hang tubes 22A and 22B, and the inner ends 54A and 54B of the depending portions 30A and 30B. The hang tubes 22A and 22B are then positioned with respect to the protective mounting bracket 12 such that the pin apertures 38A and 38B in the depending portions 30A and 30B align with the bores 45A and 45B in the bushings 44A and 44B. The journal pins 40A and 40B are inserted through the pin apertures 38A and 38B in the depending portions 30A and 30B and the bores 45A and 45B in the bushings 44A and 44B. The fasteners 43 are then fitted onto the entering ends of the journal pins 40A and 40B. The glide ride 16 is now ready to be used by the children. As the children use the glide ride 16, the glide ride 16 and the hang tubes 22A and 22B rotate or pivot conjointly with the bushings 44A and 44B about the journal pins 40A and 40B, which are held fixed by the mating rectangular configurations of the pin apertures 38B and the portions of the shanks of the journal pins 40A and 40B. The polymeric composition of the bushings 44A and 44B can reduce wear on the journal pins 40A and 40B.

This novel construction of the protective mounting bracket 12 presents a number of distinct advantages over the swing sets and the protective covers of the prior art, such as the one discussed earlier. The vertical protective clearance between the axes of elongation of the journal pins 40A and 40B and the apexes 52A and 52B of the convex surfaces 50A and 50B is sufficient to reduce the probability that small children may be able to place their fingers adjacent the journaled connection between the hang tubes 22A and 22B and the journal pins 40A and 40B. In addition, the horizontal protective clearance between the outer surfaces of the hang tubes 22A and 22B and the inner ends 54A and 54B of the depending portions 30A and 30B is sufficient such that the horizontal clearance does not form a "pinch point." The protective clearances are greater than the corresponding clearances offered by the construction disclosed in the above-referenced patent to Grudoski, and thereby may make it more difficult for a child to place his fingers near the journaled connections. Because the protective mounting bracket 12 integrates both a mounting bracket and a protective cover, swing sets having the novel protective mounting bracket 12 may be easier and quicker to assemble than some swing sets of the prior art, such as the swing set disclosed in the above-referenced patent to Cunard, because less parts are involved. Because fewer fasteners are used, the likelihood of failure of a fastener during use of the swing set 10 is correspondingly reduced. Also, the protective cover cannot become separated from the mounting bracket.

While embodiments of the present invention are shown and described, it is envisioned that those skilled in the art may devise various modifications of the present invention without departing from the spirit and scope of the appended claims.

claim:

1. A mounting bracket for pivotally attaching a glide ride to a playground set superstructure, the mounting bracket comprising:

a) a protective member comprising a top portion and a pair of depending side portions spaced apart a distance for accepting glide ride hang tubes therebetween;

b) a mounting flange connectable with the protective member for fixedly securing the protective member and the mounting flange to a playground set superstructure; and c) the depending side portions of the protective member each being of unitary construction and including apertures with a pin therethrough, the pin being configured to provide a pivotal connection between a glide ride and the protective member; and the depending side portions being dimensioned for providing a protective clearance around the pivotal connection in that the depending side portions each have a distal edge which is arcuate in shape and said edges have a radius of curvature of greater than about 3 inches.

2. The mounting bracket as defined in claim 1 wherein the side portions are held in a fixed spaced-apart distance by the flat top portion.

3. The mounting bracket as defined in claim 2 wherein the side portions and top portion are formed as an integral structure.

4. A playground set including a superstructure, a play device comprising at least one hang tube and a mounting bracket for pivotally attaching the play device to the playground set superstructure, the mounting bracket comprising:

a) a protective member comprising a top portion and a pair of depending side portions spaced apart a distance for accepting the hang tube therebetween; the play device hang tube being pivotally connected to the protective member by a pin extending between apertures in the side portions of the protective member; the side portions each being of unitary construction and dimensioned for providing i) a protective clearance around the pivotal pin connection in that the depending side portions each have a distal edge which is arcuate in shape and said edges have a radius of curvature of greater than about 3 inches and ii) a clearance between the hang tube and each side portion distal edge of at least 0.5 inches; and b) a mounting flange connectable with the protective member for connecting the play device and the superstructure.

5. A playground set as defined in claim 4 further comprising:

c) a bushing disposed around the pin such that the bushing pivots substantially conjointly with the play device while the pin remains substantially stationary with respect to the playground set superstructure.

6. The playground set of claim 4 wherein the top portion is connected to the superstructure and the top portion and depending site portions are formed as an integral structure.

7. The playground set of claim 4 wherein the protective member and the mounting flange provide the sole connection between the play device and the superstructure.

8. The playground set as defined in claim 4 wherein the distance between the outer surface of the hang tube and said distal edges is about 0.56 inches.

9. A mounting bracket for pivotally attaching a glide ride to a playground set superstructure, the mounting bracket comprising:

a) a protective member comprising a pair of side portions held in a fixed, spaced-apart distance, the side portions each being of unitary construction and having mountings for pivotally attaching a glide ride between the side portions, the side portions being dimensioned for providing a protective clearance around the pivotal attachment mountings in that the side portions each have a distal edge which is arcuate in shape and said edges have a radius of curvature of greater than about 3 inches, the side portions having a strength sufficient to mount a glide ride to a playground set superstructure.

10. A mounting bracket as defined in claim 9 wherein the mountings comprise journal pin apertures.

11. A mounting bracket as defined in claim 9 wherein the site portions are held in a fixed spaced-apart distance by a flat top portion.

12. The mounting bracket as defined in claim 11 wherein the side portions and top portion are formed as an integral structure.

13. A mouting bracket as defined in claim 9 further comprising a mounting flange connectable with the protective member for fixedly securing the protective member to a playground set superstructure.

* * * * *